US005356302A

United States Patent [19]

Inoue et al.

[11] Patent Number: 5,356,302

[45] Date of Patent: Oct. 18, 1994

[54] JOINT CONNECTOR

[75] Inventors: Nori Inoue; Athushi Sakatani, both of Yokkaichi, Japan

[73] Assignee: Sumitomo Wiring Systems, Ltd., Yokkaichi, Japan

[21] Appl. No.: 98,906

[22] Filed: Jul. 29, 1993

[30] Foreign Application Priority Data

Aug. 25, 1992 [JP] Japan ..... 4-225675

[51] Int. Cl.[5] ..... H01R 29/00

[52] U.S. Cl. ..... 439/189; 439/595

[58] Field of Search ..... 439/189, 594, 595, 597–600, 439/603, 752

[56] References Cited

U.S. PATENT DOCUMENTS

| | | | |
|---|---|---|---|
| 4,527,857 | 7/1985 | Hughes et al. . | |
| 4,685,755 | 8/1987 | Pitsch . | |
| 4,695,112 | 9/1987 | Matson et al. | 439/680 |
| 4,952,155 | 8/1990 | Kuzuno et al. . | |
| 4,954,090 | 9/1990 | Shimochi . | |
| 4,959,019 | 9/1990 | Shimochi . | |
| 5,167,534 | 12/1992 | Ohsumi | 439/595 |
| 5,199,902 | 4/1993 | Kahle et al. | 439/595 |
| 5,203,722 | 4/1993 | Kinoshita | 439/595 |

FOREIGN PATENT DOCUMENTS

| | | |
|---|---|---|
| 0122780 | 10/1984 | European Pat. Off. . |
| 0233527 | 8/1987 | European Pat. Off. . |
| 3203811 | 8/1983 | Fed. Rep. of Germany . |

OTHER PUBLICATIONS

English Language Abstract of the German Patent No. 3,203,811.

European Search Report and Annex dated Dec. 17, 1993.

*Primary Examiner*—Khiem Nguyen

*Attorney, Agent, or Firm*—Sandler Greenblum & Bernstein

[57] ABSTRACT

A joint connector comprising a plurality of terminals a housing and a bus bar plate. Each terminal accommodated in one of terminal-accommodating chambers of the housing has a slit groove making a right angle with a direction in which the terminal is inserted into the terminal-accommodating chamber. The housing has a slit opening formed at a position corresponding to the position of the slit groove. The bus bar plate is inserted into the housing via the slit opening. The lower end of the bus bar plate is pressed against the slit groove while the upper end of the bus bar plate is positioned inside the slit opening. In this manner, the bus bar plate is fixed to the housing.

4 Claims, 4 Drawing Sheets

JOINT CONNECTOR

BACKGROUND OF THE INVENTION

1. Field of the Invention

The present invention relates to a joint connector to be used to alter the wiring of electrical parts of an automobile or the like, and more particularly to the joint connector comprising a small number of component parts and thus having a simple construction.

2. Description of the Related Art

An example of a conventional joint connector is described below with reference to FIG. 9. In the joint connector, a housing 1 has a plurality of chambers 1*a* for accommodating a terminal 2. In this example, the housing 1 has five chambers 1*a* and each chamber accommodates a terminal 2. A cover 4 incorporating a plurality of bus bars 3 is engaged by the housing 1 so as to connect each of a plurality of the terminals 2 with each of the bus bars 3.

However, the conventional joint connector comprises many component parts such as the housing 1, the terminals 2, the bus bars 3, the cover 4, and the like.

It is to be noted that in this type of joint connector, it is often necessary to double-lock each terminal 2. Consequently, the construction of a retainer 1*b* of the housing 1 and that of each bus bar 3 are complicated and thus it is expensive to manufacture the joint connector.

SUMMARY OF THE INVENTION

It is an object of the present invention to provide a joint connector comprising a small number of component parts so as to allow the joint connector to have a simple construction and manufactured at a low cost.

In accomplishing these and other objects, there is provided a joint connector comprising: a plurality of terminals each having a slit groove making a right angle with a terminal-inserting direction; a housing having a plurality of terminal-accommodating chambers, each accommodating one terminal; and a bus bar plate inserted into a slit groove of each terminal accommodated in one of the terminal-accommodating chambers and pressed against the slit groove. In this manner, the bus bar plate is fixed to the housing.

According to the above construction of the joint connector, the bus bar plate is inserted into the slit groove of the terminal accommodated in the terminal-accommodating chamber of the housing and pressed against the slit groove of the terminal. Therefore, it is unnecessary to provide the joint connector with a cover to protect the bus bar unlike the conventional joint connector. Thus, the joint connector can be composed of a small number of component parts.

Further, the bus bar plate is inserted into the slit groove of the terminal so as to lock the bus bar plate to the housing. Therefore, the terminal can be double-locked to the housing without providing the joint connector with a retainer unlike the conventional joint connector. Thus the joint connector has a simple construction.

Furthermore, since the bus bar is plate-shaped, the construction of the housing can be simplified and thus the joint connector can be assembled easily and in addition, the cost for manufacturing the joint connector is much lower than that for manufacturing the conventional joint connector.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
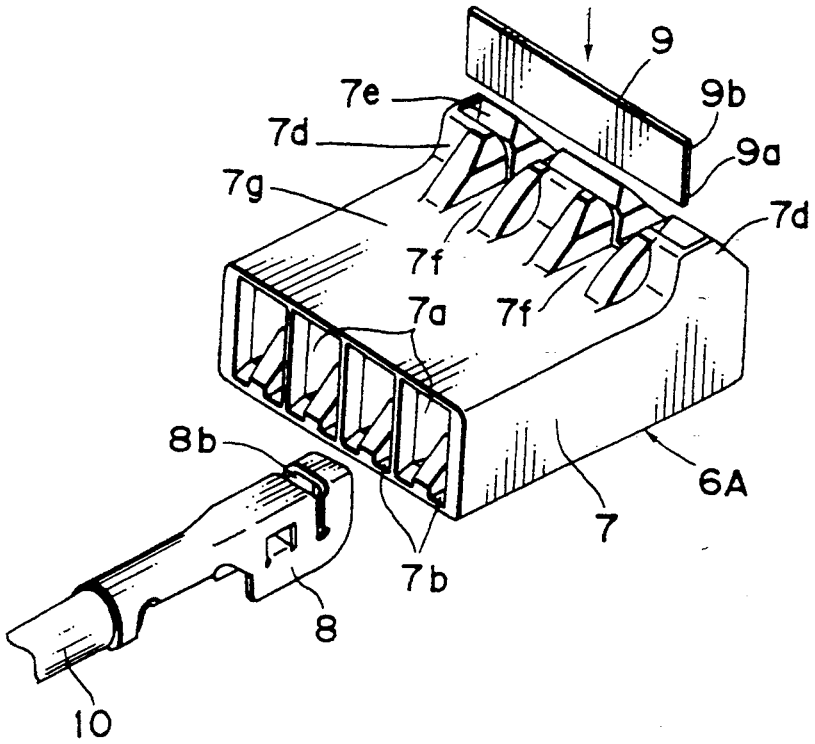
FIG. 1 is a perspective view showing a joint connector according to a first embodiment of the present invention.

Before the description of the present invention proceeds, it is to be noted that like parts are designated by like reference numerals throughout the accompanying drawings.

Referring to FIGS. 1 through 4, a joint connector 6A according to a first embodiment of the present invention is described below.

Figure 2:
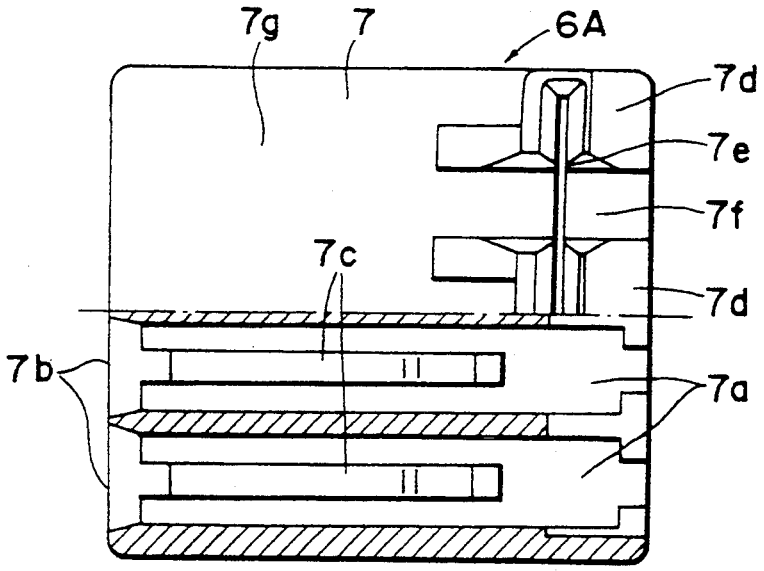
FIG. 2 is a partially sectional plan view showing the joint connector of FIG. 1.
Figure 3:
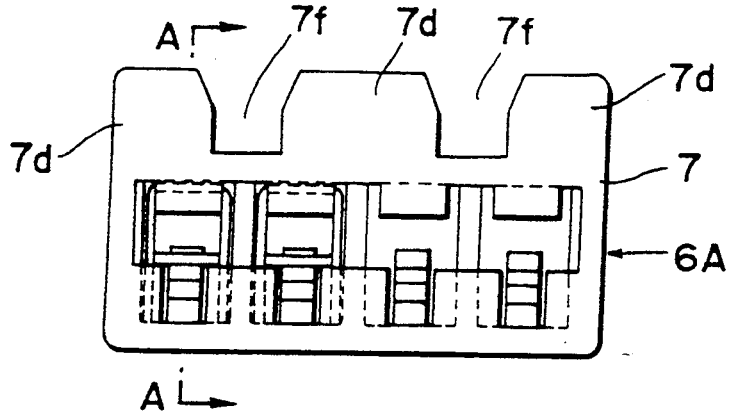
FIG. 3 is a front view showing the joint connector of FIG. 1.
Figure 4:
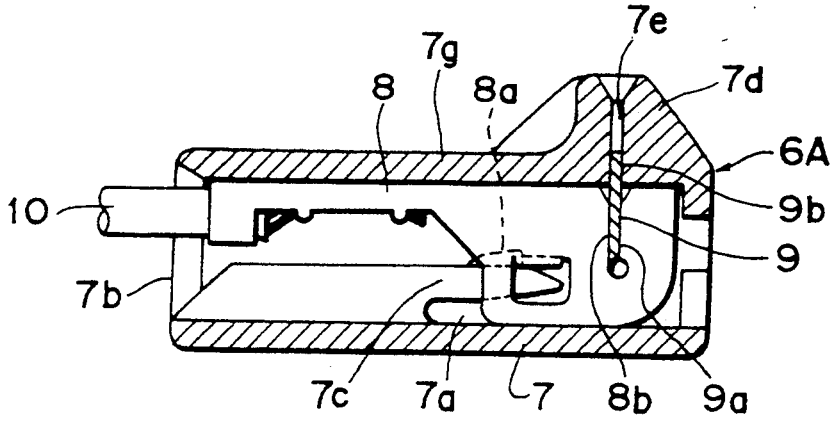
FIG. 4 is a sectional view, showing the joint connector of FIG. 1, taken along a line A—A of FIG. 3.

As shown in FIGS. 1 and 2, a plurality (four in the first embodiment) of chambers 7*a* for accommodating terminal 8 is formed in a housing 7 made of synthetic resin at regular intervals in the width direction of the housing 7. As shown in FIG. 4, the housing 7 has a lance 7*c* formed in the bottom of each chamber 7*a* so that the lance 7*c* locks a locking portion 8*a* of a terminal 8 inserted into the chamber 7*a* from a rear opening 7*b* positioned in the rear thereof.

A wiring cord 10 is fixed to the rear portion of each terminal 8 under pressure. A slit groove 8*b* is formed on an upper front portion of the terminal 8. The slit groove 8*b* is perpendicular to the direction in which the terminal 8 is inserted into the chamber 7*a* of the housing 7.

The upper front portion of the housing 7 is projected to form a plurality of convex portions 7*d* spaced at regular intervals 7*f* in the width direction of the housing 7. A slit opening 7*e* is formed in the upper front portion of the housing 7 so that the slit opening 7*e* coincides with the slit groove 8*b* of the terminal 8 inserted into each chamber 7*a*. The slit opening 7*e* extends through the convex portion 7*d* and the interval 7*f*. Therefore, the chamber 7*a* communicates with the outside via the slit opening 7*e*.

A bus bar plate 9 according to the first embodiment is rectangular.

The bus bar plate 9 is so thick that it can be inserted through the slit opening 7*e* of the housing 7 as well as the slit groove 8*b* of the terminal 8 and pressed against the slit groove 8*b*.

The length of the bus bar plate 9 in the vertical direction thereof is set as follows: That is, the upper end 9*b* of the bus bar plate 9 is positioned within the slit opening 7*e* formed through an upper wall 7*g* of the housing 7, when the bus bar plate 9 has been inserted into the slit opening 7*e* of the housing 7 and the lower end 9*a* of the bus bar plate 9 is in contact with the lower end of the slit groove 8*b* of the terminal 8.

The method of assembling the joint connector 6A from the housing 7, the terminal 8, the bus bar plate 9, and other component parts is described below.

First, the terminal 8 is inserted into the chamber 7*a* from the rear opening 7*b* thereof. The locking portion 8*a* of each terminal 8 is locked by the lance 7*c*.

Then, when the upper end 9*b* of the bus bar plate 9 becomes flush with the upper surface of the upper wall 7*g* in inserting the bus bar plate 9 downward into the slit opening 7*e* of the housing 7 as shown in FIG. 1, a jig (not shown) is used to press the bus bar plate 9 downward into the slit groove 8*b* of the terminal 8 until the lower end 9*a* of the bus bar plate 9 reaches a predetermined position, namely, the bottom of the slit groove 8*b*. The space 7*f* is utilized to press the bus bar plate 9 downward. That is, the portion of the bus bar plate 9 corresponding to the space 7*f* is pressed by the jig.

In the joint connector 6A according to the first embodiment, the bus bar plate 9 is accommodated in the slit opening 7*e* of the housing 7. Therefore, it is unnecessary to provide the joint connector 6A with the cover 4 (FIG. 9) unlike the conventional joint connector described previously.

When the lower end 9*a* of the bus bar plate 9 is in contact with the bottom of the slit groove 8*b*, the upper end 9*b* of the bus bar plate 9 is positioned within the slit opening 7*e* of the housing 7, i.e., the bus bar plate 9 is locked by the slit opening 7*e*. Therefore, the bus bar plate 9 serves as a means for preventing the terminal 8 from being removed from the chamber 7*a*.

That is, in the joint connector 6A according to the first embodiment, the terminal 8 is double-locked, i.e., the terminal 8 is locked by the lance 7*c* and the bus bar plate 9. Accordingly, it is unnecessary to provide the joint connector 6A with the retainer 1*b* (FIG. 9) unlike the conventional joint connector.

In the first embodiment, one bus bar plate 9 is connected with four terminals 8, but the bus bar plate 9 may be connected with the terminals 8 in a different manner. For example, the bus bar plate 9 may be divided into two sections longitudinally so that each of the two sections of the bus bar plate 9 is connected with two terminals 8.

Figure 5:
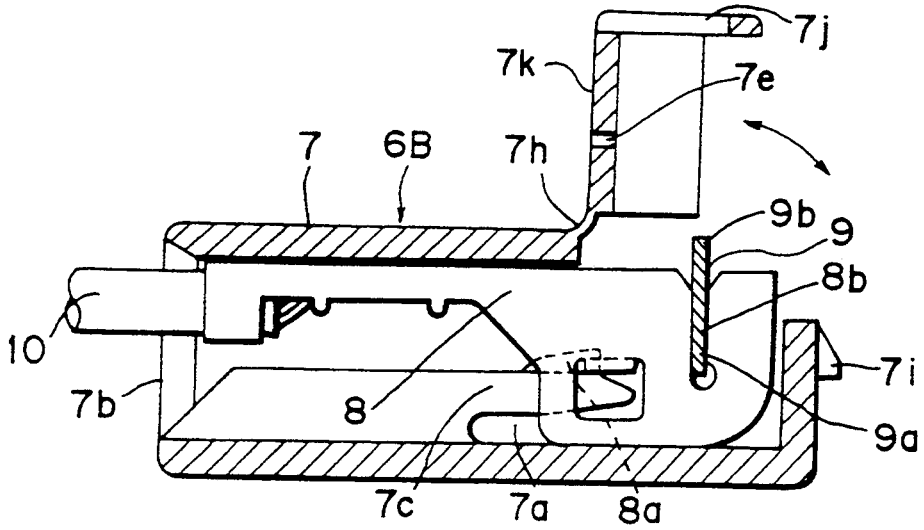
FIG. 5 is a sectional view showing a joint connector according to a second embodiment of the present invention.

A joint connector 6B according to the second embodiment is described below with reference to FIG. 5.

In the joint connector 6B, an open portion formed in the upper front portion of the housing 7 is opened and closed by a cover 7*k*.

The cover 7*k* has a flexible hinge portion 7*h* formed at the rear end thereof; and an opening 7*j* formed at the front end thereof so that a locking claw 7*i* of the housing 7 is tightly inserted into the locking opening 7*j* when the cover 7*k* has been closed. The cover 7*k* further comprises a slit opening 7*e* formed at a position corresponding to the slit groove 8*b* of the terminal 8.

The method of assembling the joint connector 6B from the housing 7, the terminal 8, the bus bar plate 9, the cover 7*k*, and other component parts is described below. First of all, the bus bar plate 9 is inserted into the slit groove 8*b* of the terminal 8 from the lower end 9*a* thereof with the cover 7*k* opened, and then, the cover 7*k* is closed so that the locking claw 7*i* of the housing 7 is tightly inserted into the opening 7*j* of the cover 7*k*. As a result, the upper end 9*b* of the bus bar plate 9 and the vicinity thereof are inserted into the slit opening 7*e* of the cover 7*k*.

It is possible to insert the bus bar plate 9 downward into the slit opening 7*e* after the cover 7*k* is closed.

Figure 9:
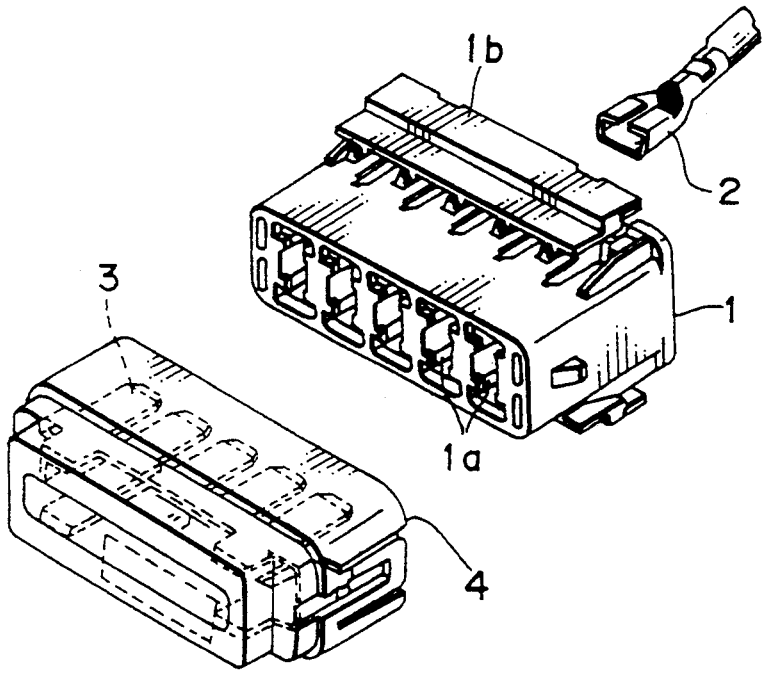
Fig. 9 PRIOR ART
FIG. 9 is a perspective view showing a conventional joint connector.

Similarly to the first embodiment, the bus bar plate 9 is inserted into the slit groove 8*b* of the terminal 8 via the slit opening 7*e* of the housing 7. Therefore, it is unnecessary to provide the joint connector 6B with the cover 4 to protect the bus bar plate 9 as shown in FIG.9. In addition, since the bus bar plate 9 serves as a means for preventing the terminal 8 from being removed from the chamber 7*a*, it is unnecessary to provide the joint connector 6B with the retainer 1*b* as shown in FIG.9 to double-lock the terminal 8 unlike the conventional joint connector.

The other constructions and operations of the joint connector 7B according to the second embodiment are similar to those of the joint connector 6A according to first embodiment. Therefore, the descriptions thereof are omitted herein.

Figure 6:
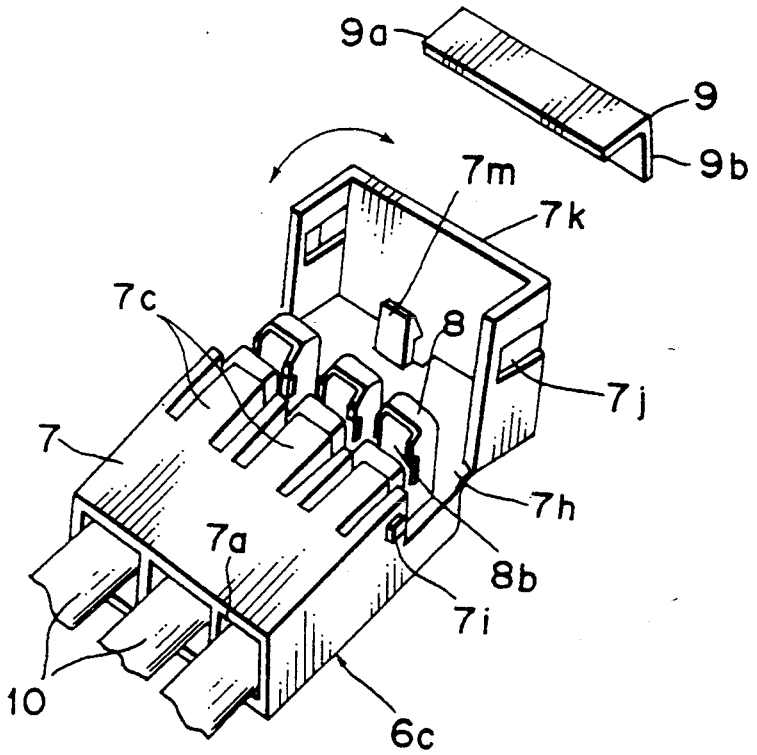
FIG. 6 is a perspective view showing a joint connector according to a third embodiment of the present invention.

A joint connector 6C according to the third embodiment is described below with reference to FIG. 6.

In the joint connector 6C, a flexible hinge portion 7*h* is continuous with an open portion disposed in the front of the housing 7 as well as the rear of the cover 7*k*. The open portion of the housing 7 is opened and closed by the cover 7*k*.

The cover 7*k* has the opening 7*j* into which the locking claw 7*i* of the housing 7 is inserted, when the open portion of the housing 7 has been closed by the cover 7*k*. A cantilever-shaped stop arm 7*m* is formed on an inner surface of the cover 7*k*. The upper portion of the stop arm 7*m* tapers off to a point.

The bus bar plate 9 according to the third embodiment is sectionally L-shaped.

The method of assembling the joint connector 6C from the housing 7, the terminal 8, the bus bar plate 9, the cover 7*k*, and other component parts is described below. First of all, the bus bar plate 9 is inserted into the slit groove 8*b* of the terminal 8 from the lower end 9*a* thereof with the cover 7*k* opened, and then, the cover 7*k* is closed to tightly insert the locking claw 7*i* of the housing into the opening 7*j* of the cover 7*k*.

At this time, the upper end 9*b* of the L-shaped bus bar plate 9 is sandwiched between the inner surface of the cover 7*k* and the stop arm 7*m*. In this manner, the bus bar plate 9 is locked by the cover 7*k*.

Figure 7:
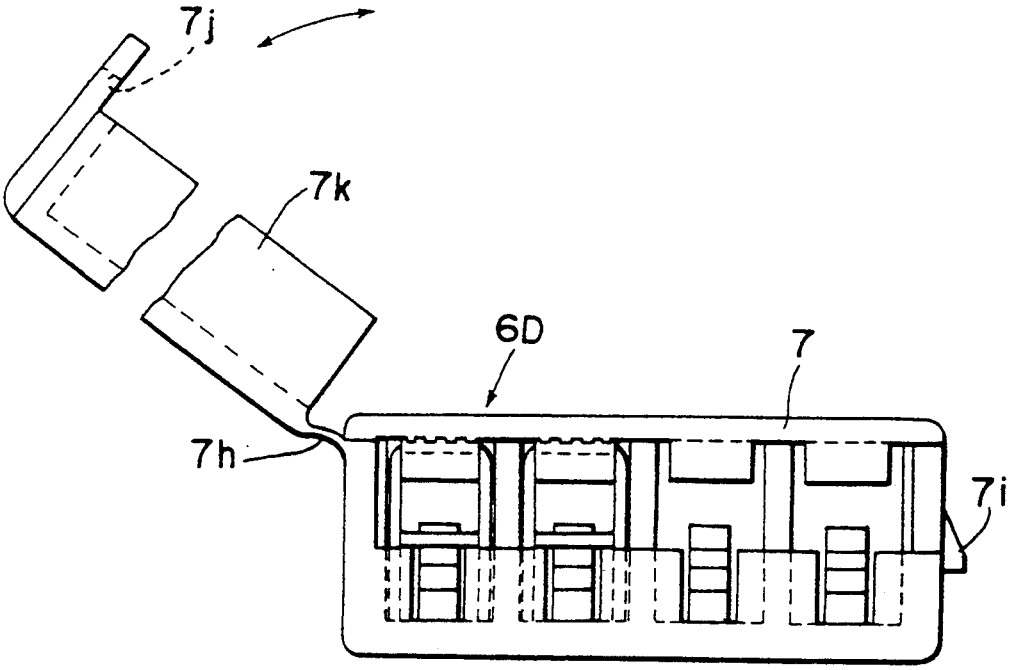
FIG. 7 is a front view showing a joint connector according to a fourth embodiment of the present invention.
Figure 8:
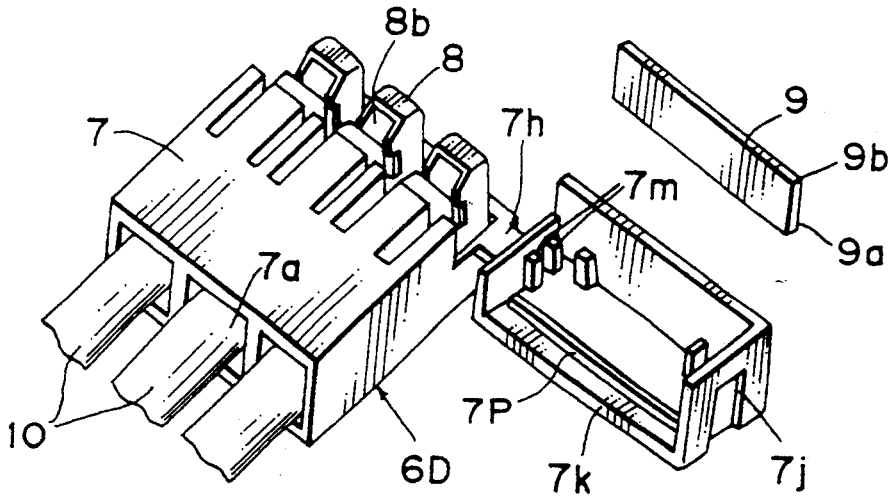
FIG. 8 is a perspective view showing the joint connector of FIG. 7.

A joint connector 6D according to the fourth embodiment is described below with reference to FIGS. 7 and 8.

In the joint connector 6C, an open portion disposed in the front of the housing 7 is opened and closed by the cover 7*k*, similarly to the second and third embodiments.

The hinge portion 7*h* disposed at one side wall of the cover 7*k* is integral with the housing 7. The locking claw 7*i* of the housing 7 is tightly inserted into the opening 7*j* of the cover 7*k*.

In the joint connector 6D according to the fourth embodiment, a pair of locking projections 7*m* is formed on the inner surface of both side walls of the cover 7*k*. The upper end 9*b* of the bus bar plate 9 is inserted between the pair of the locking projections *7m* so that the bus bar plate 9 is locked thereby.

A rib *7p* for detecting the lance *7c* is formed on the entire inner surface of the cover *7k* in the width direction of the cover *7k*.

The method of assembling the joint connector 6C from the housing 7, the terminal 8, the bus bar plate 9, the cover *7k*, and other component parts is described below. First of all, the upper end *9b* of the bus bar plate 9 is locked by the locking projection *7m* of the cover *7k* with the cover *7k* opened, and then, the cover *7k* is closed. As a result, the lower end *9a* of the bus bar plate 9 is inserted into the slit groove *8b* of the terminal 8 and the locking claw *7i* of the housing 7 is tightly inserted into the opening *7j* of the cover *7k*.

If the lance *7c* has not engaged the terminal 8 in closing the cover *7k*, the leading end of the lance *7c* is positioned outside the housing 7. Consequently, the rib *7p* is brought into contact with the upper surface of the lance *7c* even though an operation for closing the cover *7k* is made to close the cover *7k*. As a result, the locking claw *7i* of the housing 7 cannot be inserted into the opening *7j* of the cover *7k*. That is, according to the fourth embodiment, owing to the provision of the rib *7p*, the terminal 8 which has not been correctly accommodated in the terminal-accommodating chamber *7a* can be detected.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A joint connector comprising:

a housing having a plurality of chambers, each chamber accommodating one terminal and being provided with a lance for locking the terminal, and one slit opening communicating with the chambers at a right angle to an inserting direction of the terminal into the chamber, the terminals each having a slit groove at a right angle with the inserting direction of the terminal into the chamber and a locking portion locked by the lance; and a bus bar plate inserted into the slit opening of the housing and pressed against the slit groove of each terminal accommodated in the chamber so as to be locked in the housing, said bus bar plate thereby providing an electrical connection between the terminals.

2. The joint connector according to claim 1, wherein said bus bar plate is rectangular and inserted in a vertical direction into said slit groove and slit opening, a lower end of the bus bar plate being in contact with a lower end of the slit groove, and an upper end of the bus bar plate being positioned in the slit opening.

3. The joint connector according to claim 1, wherein said bus bar plate is L-shaped in cross-section, said housing has a cover for covering the slit opening and being provided with a stop arm, an upper end of the L-shaped bus bar plate being sandwiched between an inner surface of the cover and the stop arm, and a lower end of the L-shaped bus bar plate being inserted in the slit groove of the terminal and in contact with the lower end of the slit groove.

4. A joint connector comprising:

a housing having a plurality of chambers, each chamber accommodating one terminal and being provided with a lance for locking the terminal, and one slit opening communicating with the chambers at a right angle to an inserting direction of the terminal into the chamber, the terminals each having a slit groove at a right angle with the inserting direction of the terminal into the chamber and a locking portion locked by the lance; and a bus bar plate inserted into the slit opening of the housing and pressed against the slit groove of each terminal accommodated in the chamber so as to be locked in the housing;

wherein said bus bar plate is L-shaped in cross-section, said housing has a cover for covering the slit opening and being provided with a stop arm, an upper end of the L-shaped bus bar plate being sandwiched between an inner surface of the cover and the stop arm, and a lower end of the L-shaped bus bar plate being inserted in the slit groove of the terminal and in contact with the lower end of the slit groove.

* * * * *